US011478024B2

(12) United States Patent
Annunziata

(10) Patent No.: US 11,478,024 B2
(45) Date of Patent: Oct. 25, 2022

(54) MUTI-FABRIC EXPANDABLE APPAREL

(71) Applicant: Brian Annunziata, Fairfax, VA (US)

(72) Inventor: Brian Annunziata, Fairfax, VA (US)

( * ) Notice: Subject to any disclaimer, the term of this patent is extended or adjusted under 35 U.S.C. 154(b) by 0 days.

(21) Appl. No.: 16/296,823

(22) Filed: Mar. 8, 2019

(65) Prior Publication Data

US 2019/0200685 A1 Jul. 4, 2019

(51) Int. Cl.

| | |
|---|---|
| ***A41D 1/06*** | (2006.01) |
| ***A41D 31/14*** | (2019.01) |
| ***A41D 1/00*** | (2018.01) |
| ***A41D 27/20*** | (2006.01) |
| ***A41D 31/18*** | (2019.01) |

(52) U.S. Cl.

CPC ..... *A41D 1/06* (2013.01); *A41D 1/002* (2013.01); *A41D 27/20* (2013.01); *A41D 27/202* (2013.01); *A41D 27/205* (2013.01); *A41D 31/14* (2019.02); *A41D 31/18* (2019.02); *A41D 2300/322* (2013.01); *A41D 2500/50* (2013.01)

(58) Field of Classification Search

CPC ..... A41D 1/06; A41D 1/002

USPC ..... 2/227

See application file for complete search history.

(56) References Cited

U.S. PATENT DOCUMENTS

| | | | | |
|---|---|---|---|---|
| 6,654,968 | B2 * | 12/2003 | Braun | A41D 1/06 2/269 |
| 7,966,669 | B1 * | 6/2011 | Siepmann | A41D 15/002 2/123 |
| 8,832,867 | B2 * | 9/2014 | Boyle | A41D 15/002 2/227 |
| 2012/0074373 | A1 * | 3/2012 | Ramaswamy | H01L 45/1233 257/4 |
| 2016/0120246 | A1 * | 5/2016 | Boyle | A41D 1/06 2/227 |
| 2017/0065005 | A1 * | 3/2017 | Nordstrom | A41D 3/02 |
| 2018/0279693 | A1 * | 10/2018 | Wipranik | A41D 1/06 |
| 2018/0279694 | A1 * | 10/2018 | Theno | A41D 1/08 |
| 2019/0116899 | A1 * | 4/2019 | Williams | A41D 1/02 |
| 2019/0274382 | A1 * | 9/2019 | Omais | D05B 97/12 |
| 2019/0373970 | A1 * | 12/2019 | Bolker | A41D 1/089 |

* cited by examiner

*Primary Examiner* — Gloria M Hale

(74) *Attorney, Agent, or Firm* — Barry Choobin; Patent 360

(57) ABSTRACT

The various embodiments herein provide a multi-fabric apparel comprising a first fabric, a second fabric and a third fabric. The first fabric forms an upper surface of the apparel. The second fabric is stitched to the first fabric and forms a lower surface of the apparel. The third fabric is stitched between the first fabric and the second fabric forming an intermediate layer. The third fabric comprises a first layer and a second layer. The first layer is stitched between the first fabric and the second fabric, and the second layer is stitched to a second surface of the second fabric in a way that the second fabric is sandwiched between the first layer and the second layer.

7 Claims, 3 Drawing Sheets

MUTI-FABRIC EXPANDABLE APPAREL

BACKGROUND

Technical Field of Invention

The embodiments herein generally relate to a wearable apparel and particularly relates to an apparel made of multiple fabrics to facilitate utilities in a wide range of conditions and exposing features like expandability, stretch-ability, and breathability.

Description of Related Art

Different garments provide different features for users, including aesthetic and functional features, some of which overlap. Functional features include covering certain portions of the wearer's body and providing support for certain other body portions. Aesthetic features include the overall image presented when a person wears a particular garment, as well as a change in the outward appearance of certain portions of a wearer's body due to wearing the garment.

To incorporate features of different fabric in an apparel, a plurality of prior arts has been developed. One of such prior arts discloses A multi-fabric women's garment for slenderizing the midsection of a user, shaping the waistline of the user, and minimizing the roll up of the garment over the abdomen area of the user. The garment comprising an upper section including a first substantially non-compressive material, a slenderizing middle section, a lower section and a third material. The slenderizing middle section configured to be substantially horizontally around an abdomen of the user when worn and including a compressive material. The compressive material is configured to slenderize the abdomen of the user and shapes the waistline of the user. The lower section includes a second substantially non-compressive material. The lower section is configured to be used at least to position the garment over the abdomen area of the user. The third material covers at least a portion of the slenderizing middle section and conceals the at least a portion of the slenderizing middle section from the exterior of the multi-fabric garment.

Another similar prior art document discloses a composite fabric garment including a first garment portion disposed in one or more upper regions of the fabric garment. The first garment portion is formed of a first composite fabric having first inner and outer fabric layers and a first intermediate barrier layer disposed between and bonded to at least one of the first inner and outer fabric layers, the first intermediate barrier layer being breathable and substantially impermeable to wind and liquid water. The second garment portion is formed of a second composite fabric formed of second inner and outer fabric layers and having predetermined air permeability.

However, the prior arts provide a multi-fabric apparel for upper body only and are limited to sewing of the fabric layers with one another i.e. in a parallel manner. The parallel sewing of the apparel leads to simultaneous wear and tear of each fabric which further reduces a longevity of the apparel.

In the view of foregoing, there is a need for a multi-fabric apparel with a second fabric sewn to a lower half of a first fabric in order to provide utility in multiple conditions. Also, there is a need for an apparel with an intermediate layer of a third fabric between at least two layers of different fabric to enhance a utility of the apparel.

SUMMARY OF THE INVENTION

The primary objective of the embodiments is to provide a multi-fabric apparel with a second fabric sewn to a lower half of a first fabric in order to provide utility in multiple conditions.

Another objective of the embodiments herein is to provide an apparel with an intermediate layer of a third fabric between at least two layers of different fabric to enhance a utility of the apparel.

Yet another objective of the embodiments herein is to provide a multi-fabric apparel having features like expandability, stretch-ability, and breathability.

The various embodiments herein provide a multi-fabric apparel comprising a first fabric, a second fabric and a third fabric. The first fabric forms an upper surface of the apparel. The second fabric forms a lower surface of the apparel. The third fabric is stitched between the first fabric and the second fabric forming an intermediate layer. The third fabric comprises a first layer and a second layer. The first layer is stitched between the first fabric and the second fabric, and the second layer is stitched to a second surface of the second fabric in a way that the second fabric is stitched between the first layer and the second layer.

According to one embodiment herein, the first fabric is made up of a polymer material primarily a polyester.

According to one embodiment herein, the second fabric is made up of an elastomeric material, such as spandex, the structure of spandex is known in the art and is generally referred to any of various elastic textile fibers made chiefly of polyurethane.

According to one embodiment herein, the third fabric is a perforated material allowing passage of the air through the apparel.

According to one embodiment herein, the first layer of the third fabric runs on an inner surface of the first fabric throughout the apparel and the second layer runs on an inner surface of the second fabric.

According to one embodiment herein, a pair of pockets is stitched on an upper surface of the first fabric. The pair of pockets comprises colored zips on a side seam to create an open-able between a pocket and the first fabric.

According to one embodiment herein, at-least one pocket comprises an opening for a wire passage on an upper surface of the pocket.

These and other aspects of the embodiments herein will be better appreciated and understood when considered in conjunction with the following description and the accompanied drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The other objects, features and advantages will occur to those skilled in the art from the following description of the preferred embodiment and the accompanied drawings in which.

DETAILED DESCRIPTION OF THE DRAWINGS

In the following detailed description, a reference is made to the accompanied drawings that form a part hereof, and in which the specific embodiments that may be practiced is shown by way of illustration. The embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

Figure 1A:
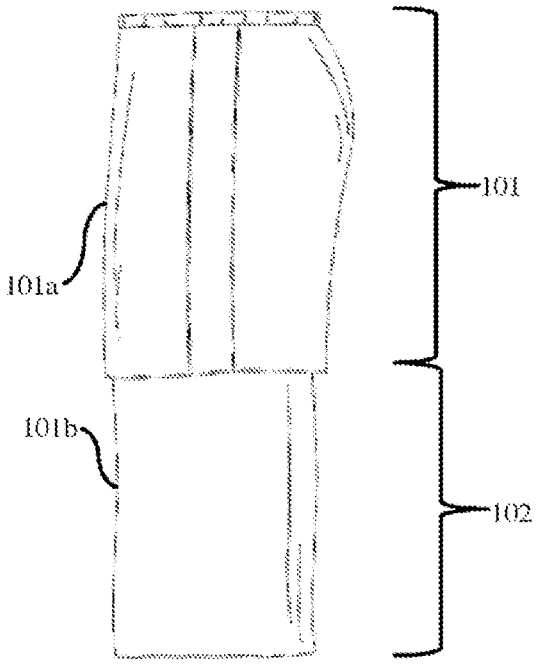
FIG. 1*a* illustrates a side view of the multi-fabric apparel with a polyester fabric and a spandex, according to one embodiment herein.
Figure 1B:
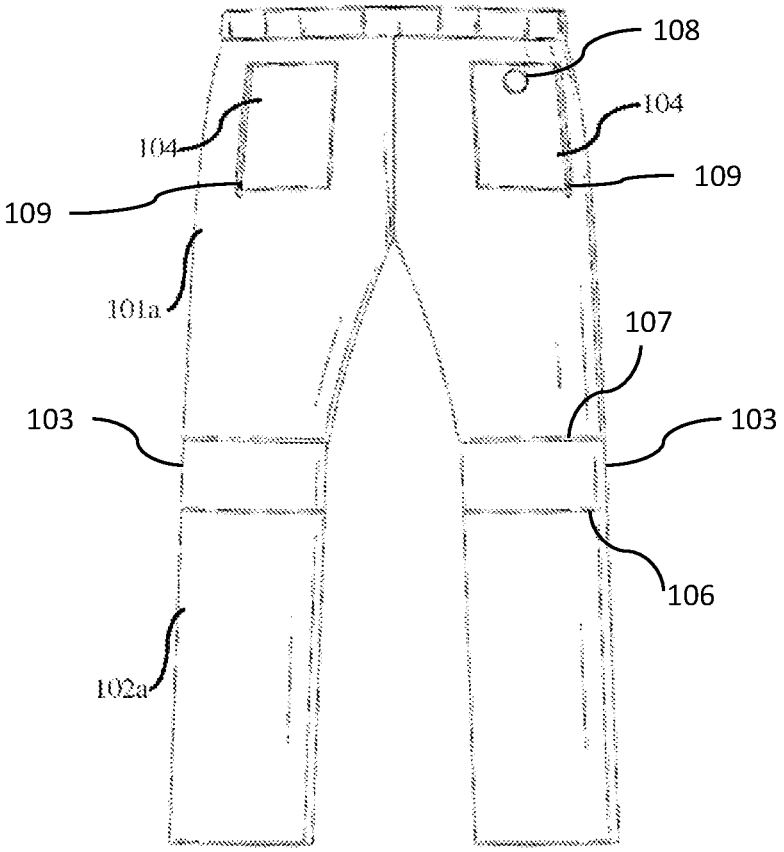
FIG. 1*b* illustrates a rear view of the multi-fabric apparel with at least two pockets, according to one embodiment herein.
Figure 1C:
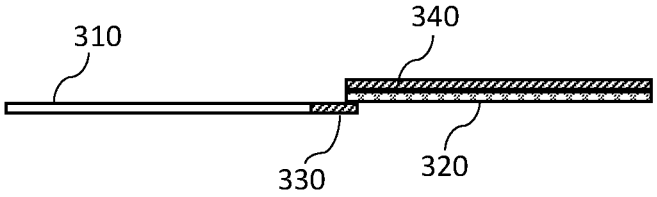
FIG. 1*c* illustrates the first fabric, the second fabric, and the third fabric arranged in the multi-fabric apparel, according to one embodiment herein.
Figure 1D:
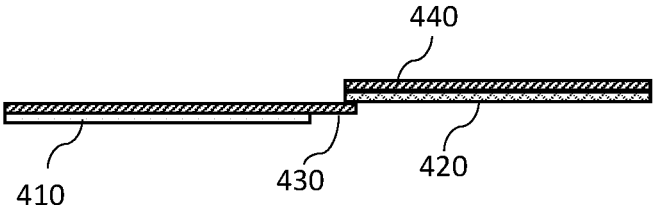
FIG. 1*d* illustrates the first fabric, the second fabric, and the third fabric arranged in the multi-fabric apparel according to another embodiment herein.

With respect to FIG. 1*a*-1*d*, the apparel comprises vertically two parts, an upper part 101 and a lower part 102. The upper part 101 is made up of a first fabric 101*a* and the lower part 102 is made up of a second fabric 102*a*. The second fabric 102*a* is stitched to the first fabric 101*a* through an inner seam. The first fabric 101*a* is primarily but not limited to a polyester material while the second fabric 102*a* is primarily but not limited to a spandex material. The inner surface of the first fabric 101*a* and the second fabric 102*a* is stitched to a third fabric 103 made up of a perforated polymer material. Also, a pair of pockets 104 is stitched on an upper surface of the first fabric 101*a*. The pair of pockets 104 comprises colored zippers on a side seam to a create an open-able between a pocket and the first fabric. FIG. 1*b* shows the zippers 109 at the side seam of the pockets 104. FIG. 1*b* shows the third fabric 103 stitched at its upper edge 107 to the first fabric 101*a* and at its lower edge 106 to the second fabric. FIG. 1*c* shows the third fabric having a first layer 330 and a second layer 340. The first layer is stitched to the first fabric 310. The first layer 330 forms an intermediate layer between the first fabric 310 and the second fabric 320. The second layer 340 is continuous with the inner surface of the second fabric 320, wherein the second fabric 320 is stitched between the first layer 330 and the second layer 340. Referring to FIG. 1*d* which shows the first layer 430 of the third fabric continuous on the inner surface of the first fabric 410. The second layer 440 of the third fabric is continuous on the inner surface of the second fabric 420 and the second fabric is stitched between the first layer 430 and the second layer 440.

The apparel is preferably wore over pelvic area such as a shorts or a track pant. The apparel provides a general utility of a water-resistant daily wear due to polyester material and a sports utility due to presence of the spandex based material and an intermediate layer of a breathing material. The apparel is further enhanced with back pocket having zippers on a longitudinal side providing an ease-of-use feature to the users. Also, due to presence of opening 108 (shown in FIG. 1*b*) on the upper surface of the back-pocket, a user can place a mobile device connected to a headphone through a headphone wire passing (wire passage) through the opening.

It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the claims.

I claim:

1. A multi-fabric apparel comprising an upper part and a lower part, a first fabric forming the upper part, a second fabric forming the lower part, and a third fabric comprises a first layer and a second layer, wherein the first layer is stitched between the first fabric and the second fabric to form an intermediate layer, and the second layer is continuous with an inner surface of the second fabric, the second fabric is stitched between the first layer and the second layer.

2. The multi-fabric apparel according to claim 1, wherein the first fabric is made up of a polyester material.

3. The multi-fabric apparel according to claim 2, wherein the second fabric is made up of an elastomeric material.

4. The multi-fabric apparel according to claim 3, wherein the third fabric is a perforated material.

5. The multi-fabric apparel according to claim 1, wherein the first layer of the third fabric is continuous with an inner surface of the first fabric throughout.

6. The multi-fabric apparel according to claim 1, wherein a pair of pockets is stitched on an upper surface of the first fabric, wherein openings of the pair of pockets along the side seam comprises colored zips.

7. The multi-fabric apparel according to claim 6, wherein at-least one pocket comprises an opening on an upper surface of the pocket for a wire to pass through.

* * * * *